US010069193B2

(12) United States Patent
Li et al.

(10) Patent No.: US 10,069,193 B2
(45) Date of Patent: Sep. 4, 2018

(54) ANTENNA AND MOBILE TERMINAL

(71) Applicant: Huawei Device (Dongguan) Co., Ltd., Dongguan (CN)

(72) Inventors: Jianming Li, Taipei (TW); Hanyang Wang, Reading (GB)

(73) Assignee: HUAWEI DEVICE (DONGGUAN) CO., LTD., Dongguan (CN)

( * ) Notice: Subject to any disclaimer, the term of this patent is extended or adjusted under 35 U.S.C. 154(b) by 25 days.

(21) Appl. No.: 15/118,323

(22) PCT Filed: Feb. 6, 2015

(86) PCT No.: PCT/CN2015/072407
§ 371 (c)(1),
(2) Date: Aug. 11, 2016

(87) PCT Pub. No.: WO2015/120780
PCT Pub. Date: Aug. 20, 2015

(65) Prior Publication Data

US 2017/0170546 A1 Jun. 15, 2017

(30) Foreign Application Priority Data

Feb. 12, 2014 (CN) ..... 2014 1 0049276

(51) Int. Cl.
*H01Q 1/24* (2006.01)
*H01Q 1/48* (2006.01)
*H01Q 1/38* (2006.01)

(52) U.S. Cl.
CPC ..... *H01Q 1/243* (2013.01); *H01Q 1/38* (2013.01); *H01Q 1/48* (2013.01)

(58) Field of Classification Search
CPC ..... H01Q 1/241–1/243; H01Q 1/38
(Continued)

(56) References Cited

U.S. PATENT DOCUMENTS 7,012,570 B2 * 3/2006 Chen ..... H01Q 1/243 343/700 MS
7,385,556 B2 6/2008 Chung et al.
(Continued)

FOREIGN PATENT DOCUMENTS

CN 101127513 A 2/2008
CN 101174730 A 5/2008
(Continued)

OTHER PUBLICATIONS

Choi, S. et al., "Design of a Compact Hexa-Band Coupling Antenna for 4G Mobile Handset using a Small Element with Two Slots," Microwave and Optical Technology Letters, vol. 55, No. 8, Aug. 2013, 4 pages.
(Continued)

*Primary Examiner* — Dameon E Levi
*Assistant Examiner* — Hasan Islam
(74) *Attorney, Agent, or Firm* — Slater Matsil, LLP

(57) ABSTRACT

An antenna and a mobile terminal with the antenna including a first radiator and a first capacitor structure. A first end of the first radiator is electrically connected to a signal feed end of a printed circuit board by means of the first capacitor structure, and a second end of the first radiator is electrically connected to a ground end of the printed circuit board. The first radiator, the first capacitor structure, the signal feed end, and the ground end form a first antenna, configured to generate a first resonance frequency. An electrical length of the first radiator is less than or equal to one eighth of a wavelength corresponding to the first resonance frequency.

18 Claims, 10 Drawing Sheets

(58) Field of Classification Search
USPC ..... 343/702, 722, 846
See application file for complete search history.

(56) References Cited

U.S. PATENT DOCUMENTS

| | | | | |
|---|---|---|---|---|
| 8,089,412 | B2 * | 1/2012 | Nishio | H01Q 9/0421 343/702 |
| 8,629,813 | B2 | 1/2014 | Milosavljevic | |
| 8,972,716 | B2 | 3/2015 | Fang et al. | |
| 2006/0017621 | A1 | 1/2006 | Okawara et al. | |
| 2007/0103373 | A1 * | 5/2007 | Wallace | H01Q 1/243 343/702 |
| 2010/0289619 | A1 | 11/2010 | Kosugi et al. | |
| 2011/0109513 | A1 | 5/2011 | Yamaki | |
| 2011/0275333 | A1 | 11/2011 | Kim et al. | |
| 2012/0001815 | A1 | 1/2012 | Wong et al. | |
| 2012/0007782 | A1 | 1/2012 | Nishio et al. | |
| 2012/0050121 | A1 | 3/2012 | Kim et al. | |
| 2012/0188135 | A1 | 7/2012 | Wong et al. | |
| 2013/0027260 | A1 | 1/2013 | Jeon et al. | |
| 2013/0050036 | A1 * | 2/2013 | Kashiwagi | H01Q 1/243 343/749 |
| 2013/0122828 | A1 | 5/2013 | Choi | |
| 2014/0002314 | A1 * | 1/2014 | Li | H01Q 1/36 343/702 |
| 2014/0131455 | A1 | 5/2014 | Takigahira | |
| 2014/0197993 | A1 | 7/2014 | Li et al. | |

FOREIGN PATENT DOCUMENTS

| | | | |
|---|---|---|---|
| CN | 101809813 | A | 8/2010 |
| CN | 101835282 | A | 9/2010 |
| CN | 101888010 | A | 11/2010 |
| CN | 102315513 | A | 1/2012 |
| CN | 102468533 | A | 5/2012 |
| CN | 103534873 | A | 1/2014 |
| EP | 2333901 | A2 | 6/2011 |
| EP | 2680365 | A1 | 1/2014 |
| TW | 201332216 | A | 8/2013 |
| WO | 2013012078 | A1 | 1/2013 |

OTHER PUBLICATIONS

Yoon, C. et al., "Broadband Antenna with Capacitive-Coupling for Mobile Handsets," Microwave and Optical Technology Letters, vol. 55, No. 6, Jun. 2013, 5 pages.

Zhao, G.H. et al., "Wideband Internal Antenna with Coupled Feeding for 4G Mobile Phone," Microwave and Optical Technology Letters, vol. 55, No. 3, Mar. 2013, 4 pages.

* cited by examiner

ANTENNA AND MOBILE TERMINAL

CROSS-REFERENCE TO RELATED APPLICATIONS

This patent application is a national phase filing under section 371 of PCT/CN2015/072407, filed Feb. 6, 2015 which claims priority to Chinese Patent Application No. 201410049276.9, filed with the Chinese Patent Office on Feb. 12, 2014 and entitled "ANTENNA AND MOBILE TERMINAL", which are hereby incorporated by reference in their entirety.

TECHNICAL FIELD

The present invention relates to the field of antenna technologies, and in particular, to an antenna and a mobile terminal.

BACKGROUND

As is well known, frequency bands commonly used in commerce at present include eight frequency bands in total, such as a Global System for Mobile Communication (GSM), GSM850 (824 MHz to 894 MHz), GSM900 (880 MHz to 960 MHz), a Global Positioning System (GPS) (1575 MHz), digital video broadcasting (DVB)-H (1670 MHz to 1675 MHz), a data communications subsystem (DCS) (1710 MHz to 1880 MHz), a personal communications service (PCS), a Universal Mobile Telecommunications System (UMTS) or a 3rd Generation Mobile Communications technology (3G) (1920 MHz to 2175 MHz), and Bluetooth or a Wireless Local Area Network (WLAN) 802.11b/g (2400 MHz to 2484 MHz). In addition, a Long Term Evolution (LTE) project is a currently popular operating frequency band, and operating frequency bands thereof include 698 MHz to 960 MHz and 1710 MHz to 2700 MHz.

An antenna is an apparatus used by a radio device to receive and transmit an electromagnetic wave signal. As the fourth generation mobile communications comes, there is an increasingly high requirement for a bandwidth of a terminal product. Because the antenna implements both signal propagation and energy radiation based on resonance of a frequency, an electrical length of the antenna is one fourth of a wavelength corresponding to a resonance frequency of the antenna, and terminal products at present become lighter and slimmer, how to design an antenna in smaller space is a problem to be urgently resolved.

SUMMARY

Embodiments of the present invention provide an antenna and a mobile terminal, so that the antenna can be designed in relatively small space.

The following technical solutions are used in the embodiments of the present invention:

According to a first aspect, an embodiment of the present invention provides an antenna, including a first radiator and a first capacitor structure, where a first end of the first radiator is electrically connected to a signal feed end of a printed circuit board by means of the first capacitor structure, a second end of the first radiator is electrically connected to a ground end of the printed circuit board, the first radiator, the first capacitor structure, the signal feed end, and the ground end form a first antenna, configured to generate a first resonance frequency, and an electrical length of the first radiator is less than or equal to one eighth of a wavelength corresponding to the first resonance frequency.

With reference to the first aspect, in a first possible implementation manner, the antenna further includes a second capacitor structure, a first end of the second capacitor structure is electrically connected to the first radiator between the first end and the second end, and a second end of the second capacitor structure is electrically connected to the ground end of the printed circuit board.

With reference to the first aspect or the first possibility of the first aspect, in a second possible implementation manner, the first capacitor structure includes an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, a gap is formed between the first branch and the second branch, and a gap is formed between the second branch and the third branch. The U-shape component includes two branches, the two branches of the U-shape component are separately located in the two gaps of the E-shape component, and the E-shape component and the U-shape component are not in contact with each other.

With reference to the second possibility of the first aspect, in a third possible implementation manner, the first end of the first radiator is electrically connected to the first branch or the third branch of the first capacitor structure.

With reference to the first possibility of the first aspect, in a fourth possible implementation manner, the second capacitor structure includes an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, a gap is formed between the first branch and the second branch, and a gap is formed between the second branch and the third branch. The U-shape component includes two branches, the two branches of the U-shape component are separately located in the two gaps of the E-shape component, and the E-shape component and the U-shape component are not in contact with each other.

With reference to the first aspect or the first possibility of the first aspect, in a fifth possible implementation manner, the antenna further includes at least one second radiator, and one end of the second radiator is electrically connected to the first end of the first radiator.

With reference to the fifth possibility of the first aspect, in a sixth possible implementation manner, the antenna further includes an L-shape second radiator, and one end of the L-shape second radiator is electrically connected to the first end of the first radiator.

With reference to the fifth possibility of the first aspect, in a seventh possible implementation manner, the antenna further includes a [-shape second radiator, and one end of the [-shape second radiator is electrically connected to the first end of the first radiator.

With reference to the fifth possibility of the first aspect, in an eighth possible implementation manner, the antenna further includes two [-shape second radiators, and openings of the two [-shape second radiators are opposite to each other, where first ends of the second radiators are electrically connected to the first end of the first radiator, and second ends of the second radiators are opposite to each other and are not in contact with each other to form a coupling structure.

With reference to the second possibility of the first aspect, in a ninth possible implementation manner, the antenna further includes at least one second radiator, and one end of the second radiator is electrically connected to either of the first branch and the third branch.

With reference to the ninth possibility of the first aspect, in a tenth possible implementation manner, the antenna further includes an L-shape second radiator, and one end of the L-shape second radiator is electrically connected to the first branch.

With reference to the ninth possibility of the first aspect, in an eleventh possible implementation manner, the antenna further includes a [-shape second radiator, and a first end of the [-shape second radiator is electrically connected to either of the first branch and the third branch.

With reference to the ninth possibility of the first aspect, in a twelfth possible implementation manner, the antenna further includes two [-shape second radiators, and openings of the two [-shape second radiators are opposite to each other, where one of the second radiators is electrically connected to the first branch, the other of the second radiators is electrically connected to the third branch, and second ends of the second radiators are opposite to each other and are not in contact with each other to form a coupling structure.

With reference to any one of the first aspect to the first twelve possibilities of the first aspect, in a thirteenth possible implementation manner, the first radiator is located on an antenna support, and a distance between a plane on which the first radiator is located and a plane on which the printed circuit board is located is between 2 millimeters and 6 millimeters.

According to a second aspect, an embodiment of the present invention provides a mobile terminal, including a radio frequency processing unit, a baseband processing unit, and an antenna, where the antenna includes a first radiator and a first capacitor structure, where a first end of the first radiator is electrically connected to a signal feed end of a printed circuit board by means of the first capacitor structure, a second end of the first radiator is electrically connected to a ground end of the printed circuit board, the first radiator, the first capacitor structure, the signal feed end, and the ground end form a first antenna, configured to generate a first resonance frequency, and an electrical length of the first radiator is less than or equal to one eighth of a wavelength corresponding to the first resonance frequency. The radio frequency processing unit is electrically connected to the signal feed end of the printed circuit board by means of a matching circuit. The antenna is configured to transmit a received radio signal to the radio frequency processing unit or convert a transmitted signal of the radio frequency processing unit into an electromagnetic wave and send the electromagnetic wave; the radio frequency processing unit is configured to perform frequency selection, amplification, and down-conversion on the radio signal received by the antenna, convert the radio signal to an intermediate frequency signal or a baseband signal, and send the intermediate frequency signal or baseband signal to the baseband processing unit, or configured to perform up-conversion and amplification on a baseband signal or an intermediate frequency signal sent by the baseband processing unit and send the baseband signal or intermediate frequency by using the antenna; and the baseband processing unit performs processing on the received intermediate frequency or baseband signal.

With reference to the second aspect, in a first possible implementation manner, the antenna further includes a second capacitor structure, a first end of the second capacitor structure is electrically connected to the first radiator between the first end and the second end, and a second end of the second capacitor structure is electrically connected to the ground end of the printed circuit board.

With reference to the second aspect or the first possibility of the first aspect, in a second possible implementation manner, the first capacitor structure includes an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, a gap is formed between the first branch and the second branch, and a gap is formed between the second branch and the third branch. The U-shape component includes two branches, the two branches of the U-shape component are separately located in the two gaps of the E-shape component, and the E-shape component and the U-shape component are not in contact with each other.

With reference to the second possibility of the second aspect, in a third possible implementation manner, the first end of the first radiator is electrically connected to the first branch or the third branch of the first capacitor structure.

With reference to the second aspect or the first possibility of the second aspect, in a fourth possible implementation manner, the antenna further includes at least one second radiator, and one end of the second radiator is electrically connected to the first end of the first radiator.

With reference to the second possibility of the second aspect, in a fifth possible implementation manner, the antenna further includes at least one second radiator, and one end of the second radiator is electrically connected to either of the first branch and the third branch.

With reference to any one of the second aspect to the fifth possibility of the second aspect, in a sixth possible implementation manner, the first radiator is located on an antenna support, and a distance between a plane on which the first radiator is located and a plane on which the printed circuit board is located is between 2 millimeters and 6 millimeters.

In the antenna and the mobile terminal provided in the embodiments of the present invention, the antenna includes a first radiator and a first capacitor structure; a first end of the first radiator is electrically connected to a signal feed end of a printed circuit board by means of the first capacitor structure, a second end of the first radiator is electrically connected to a ground end of the printed circuit board, the first radiator, the first capacitor structure, the signal feed end, and the ground end form a first antenna, configured to generate a first resonance frequency, and an electrical length of the first radiator is less than or equal to one eighth of a wavelength corresponding to the first resonance frequency, so that the antenna can be designed in relatively small space.

BRIEF DESCRIPTION OF THE DRAWINGS

To describe the technical solutions in the embodiments of the present invention more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

Figure 1:
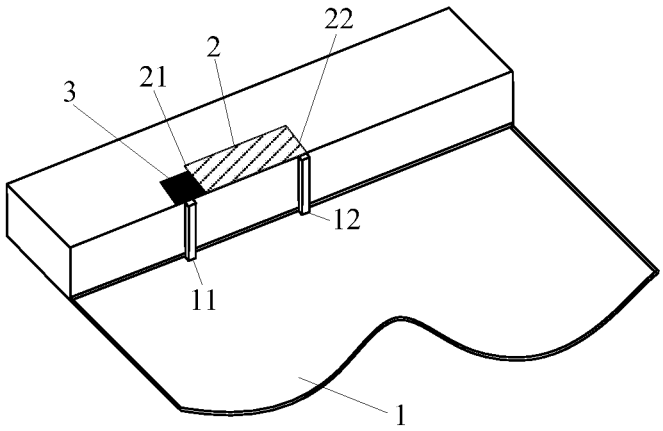
FIG. 1 is a first schematic diagram of an antenna according to an embodiment of the present invention.

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Embodiment 1

This embodiment of the present invention provides an antenna, including a first radiator 2 and a first capacitor structure 3, where a first end 21 of the first radiator 2 is electrically connected to a signal feed end 11 of a printed circuit board 1 by means of the first capacitor structure 3, a second end 22 of the first radiator 2 is electrically connected to a ground end 12 of the printed circuit board 1, the first radiator 2, the first capacitor structure 3, the signal feed end 11, and the ground end 12 form a first antenna P1, configured to generate a first resonance frequency f1, and an electrical length of the first radiator 2 is less than or equal to one eighth of a wavelength corresponding to the first resonance frequency f1.

The antenna provided in this embodiment of the present invention includes a first radiator and a first capacitor structure; a first end of the first radiator is electrically connected to a signal feed end of a printed circuit board by means of the first capacitor structure, a second end of the first radiator is electrically connected to a ground end of the printed circuit board, the first radiator, the first capacitor structure, the signal feed end, and the ground end form a first antenna, configured to generate a first resonance frequency, and an electrical length of the first radiator is less than or equal to one eighth of a wavelength corresponding to the first resonance frequency, so that the antenna can be designed in relatively small space.

Figure 2:
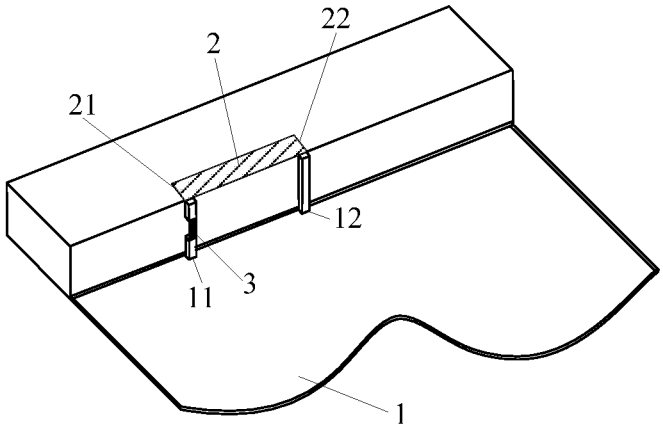
FIG. 2 is a second schematic diagram of an antenna according to an embodiment of the present invention.

In actual design, different design positions of the first capacitor structure 3 may provide different schematic diagrams of the antenna. As shown in FIG. 1, an oblique-lined portion is the first radiator 2, and a black portion is the first capacitor structure 3. As shown in FIG. 2, an oblique-lined portion is the first radiator 2, and a black portion is the first capacitor structure 3. The antennas in FIG. 1 and FIG. 2 are both configured to generate the first resonance frequency f1, and the only difference lies in different positions of the first capacitor structure 3.

Figure 3:
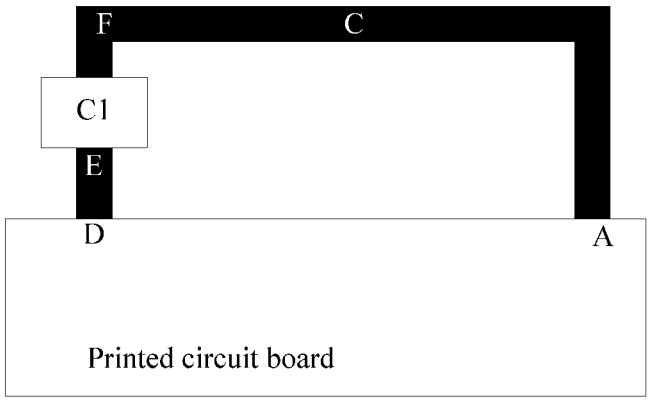
FIG. 3 is a schematic plane diagram of the antennas shown in the first schematic diagram and the second schematic diagram according to an embodiment of the present invention.

To help understand how the antennas generate the first resonance frequency f1, FIG. 3 is a schematic plane diagram of the antennas described in FIG. 1 and FIG. 2. In FIGS. 3, D, E, F, C, and A of a black portion represent the first radiator 2, C1 is used to represent the first capacitor structure 3, a white portion represents the printed circuit board 1, a portion connected to A is the ground end 12 of the printed circuit board 1, and a portion connected to D is the signal feed end 11 of the printed circuit board 1.

Figure 4:
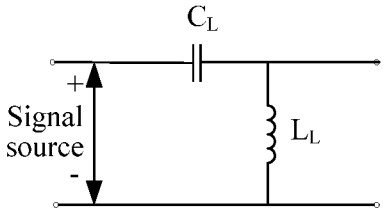
FIG. 4 is a schematic diagram of an equivalent circuit of the antennas shown in the first schematic diagram and the second schematic diagram according to an embodiment of the present invention.

Specifically, the first radiator 2, the first capacitor structure 3, the signal feed end 11, and the ground end 12 form the first antenna P1, and a circuit diagram of an equivalent of the first antenna P1, as shown in FIG. 4, conforms to a left-hand transmission line (Left Hand Transmission Line) principle. D, E, F, C, and A sections of the first radiator 2 are equivalent to an inductor $L_L$ connected in parallel to a signal source, the first capacitor structure 3 is equivalent to a capacitor $C_L$ connected in series to the signal source and is configured to generate the first resonance frequency f1, where the first resonance frequency f1 may cover resonance frequencies of low frequency bands such as LTE B13, LTE B17, and LTE B20.

Figure 5:
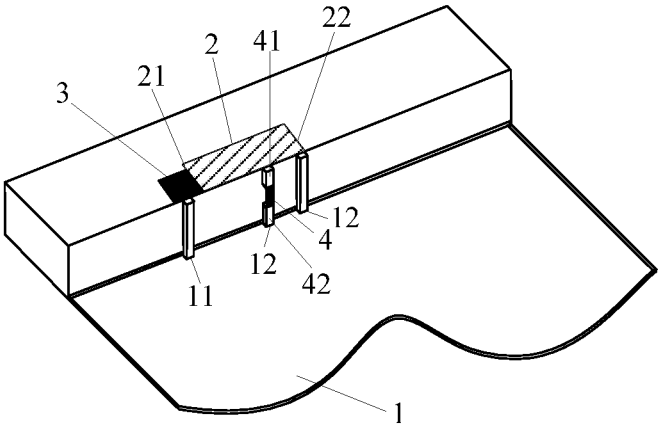
FIG. 5 is a third schematic diagram of an antenna according to an embodiment of the present invention.
Figure 6:
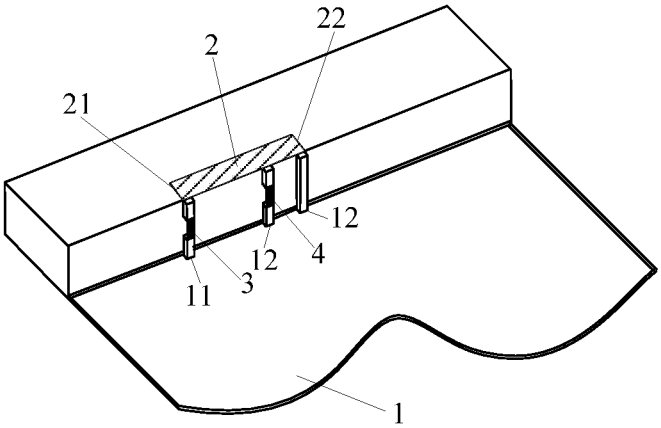
FIG. 6 is a fourth schematic diagram of an antenna according to an embodiment of the present invention.

Further, as shown in FIG. 5 and FIG. 6, the antenna further includes a second capacitor structure 4, a first end 41 of the second capacitor structure 4 is electrically connected to any position, other than the first end 21 and the second end 22, in the first radiator 2, and a second end 42 of the second capacitor structure 4 is electrically connected to the ground end 12 of the printed circuit board 1.

As shown in FIG. 5, an oblique-lined portion is the first radiator 2, and black portions are the first capacitor structure 3 and the second capacitor structure 4; as shown in FIG. 6, an oblique-lined portion is the first radiator 2, and black portions are the first capacitor structure 3 and the second capacitor structure 4.

Figure 7:
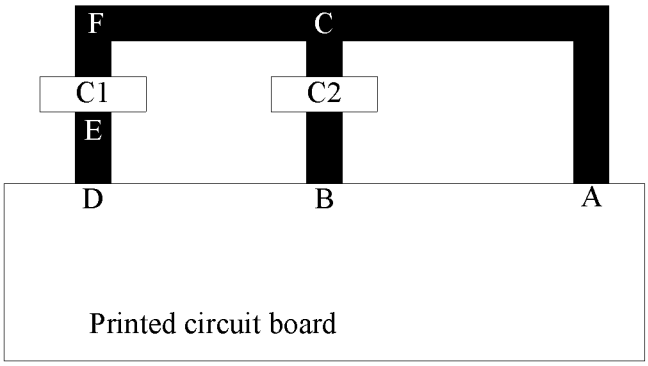
FIG. 7 is a schematic plane diagram of the antennas shown in the third schematic diagram and the fourth schematic diagram according to an embodiment of the present invention.

To help understand the antenna, FIG. 7 is a schematic plane diagram of the antennas described in FIG. 5 and FIG. 6. In FIGS. 7, D, E, F, C, and A are used to represent the first radiator 2, C1 is used to represent the first capacitor structure 3, C2 is used to represent the second capacitor structure 4, and a white portion represents the printed circuit board 1.

Figure 8:
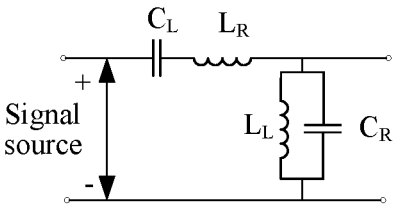
FIG. 8 is a schematic diagram of an equivalent circuit of the antennas shown in the third schematic diagram and the fourth schematic diagram according to an embodiment of the present invention.

Specifically, as regards the antennas shown in FIG. 5 and FIG. 6, a circuit diagram of an equivalent of the first radiator 2, the first capacitor structure 3, the second capacitor structure 4, the signal feed end 11, and the ground end 12, as shown in FIG. 8, forms a composite right/left-hand transmissions line (Composite Right Hand and Left Hand Transmission Line, CRLH TL for short) structure. The first capacitor structure 3 is equivalent to a capacitor $C_L$ connected in series to the signal source, the second capacitor structure 4 is equivalent to a capacitor $C_R$ connected in parallel to the signal source, the F and C sections of the first radiator 2 are equivalent to an inductor $L_R$ in series to the signal source, as regards the first radiator 2, the C and A sections are equivalent to an inductor $L_L$ connected in parallel to the signal source, the first capacitor structure 3, the first radiator 2, the signal feed end 11, and the ground end 12 form a left-hand transmission line structure, configured to generate the first resonance frequency f1, where the first resonance frequency f1 may cover resonance frequencies of low frequency bands such as LTE B13, LTE B17, and LTE B20, and the F and C sections of the first radiator 2, the second capacitor structure 4, the signal feed end 11, the ground end 12 form a right-hand transmission line structure, configured to generate a second resonance frequency f2, where the second resonance frequency f2 may cover LTE B21 (1447.9 MHz to 1510.9 MHz).

Optionally, the first capacitor structure 3 may be an ordinary capacitor, and the first capacitor structure 3 may include at least one capacitor connected in series or in parallel in multiple forms (which may be referred to as a capacitor build-up assembly). The first capacitor structure 3 may also include an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, a gap is formed between the first branch and the second branch, and a gap is formed between the second branch and the third branch. The U-shape component includes two branches, the two branches of the U-shape component are separately located in the two gaps of the E-shape component, and the E-shape component and the U-shape component are not in contact with each other.

Figure 9:
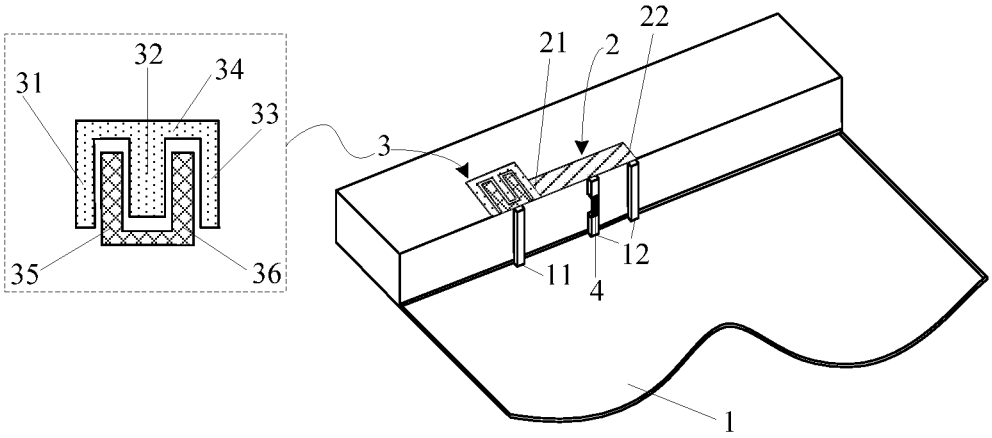
FIG. 9 is a fifth schematic diagram of an antenna according to an embodiment of the present invention.

As shown in FIG. 9, a portion indicated by oblique lines is the first radiator 2, a portion indicated by the black color is the second capacitor structure 4, and the first capacitor structure 3 includes the E-shape component and the U-shape component, where a portion indicated by dots is the E-shape component, and a portion indicated by double oblique lines is the U-shape component. The E-shape component includes a first branch 31, a second branch 32, a third branch 33, and a fourth branch 34, where the first branch 31 and the third branch 33 are connected to two ends of the fourth branch 34, the second branch 32 is located between the first branch 31 and the third branch 33, the second branch 32 is connected to the fourth branch 34, a gap is formed between the first branch 31 and the second branch 32, and a gap is formed between the second branch 32 and the third branch 33. The U-shape component includes two branches: a branch 35 and the other branch 36; the branch 35 of the U-shape component is located in the gap formed between the first branch 31 and the second branch 32 of the E-shape component, the other branch 36 of the U-shape component is located in the gap formed between the second branch 32 and the third branch 33 of the E-shape component, and the E-shape component and the U-shape component are not in contact with each other.

Optionally, when the first capacitor structure 3 includes the E-shape component and the U-shape component, the first end 21 of the first radiator 2 is electrically connected to the first branch 31 or the third branch 33 of the first capacitor structure 3. As shown in FIG. 9, the first end 21 of the first radiator 2 is electrically connected to the third branch 33 of the first capacitor structure 3.

Optionally, the second capacitor structure 4 may be an ordinary capacitor, and the second capacitor structure 4 may include at least one capacitor connected in series or in parallel in multiple forms (which may be referred to as a capacitor build-up assembly). The second capacitor structure 4 may also include an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, a gap is formed between the first branch and the second branch, and a gap is formed between the second branch and the third branch. The U-shape component includes two branches, the two branches of the U-shape component are separately located in the two gaps of the E-shape component, and the E-shape component and the U-shape component are not in contact with each other.

Figure 10:
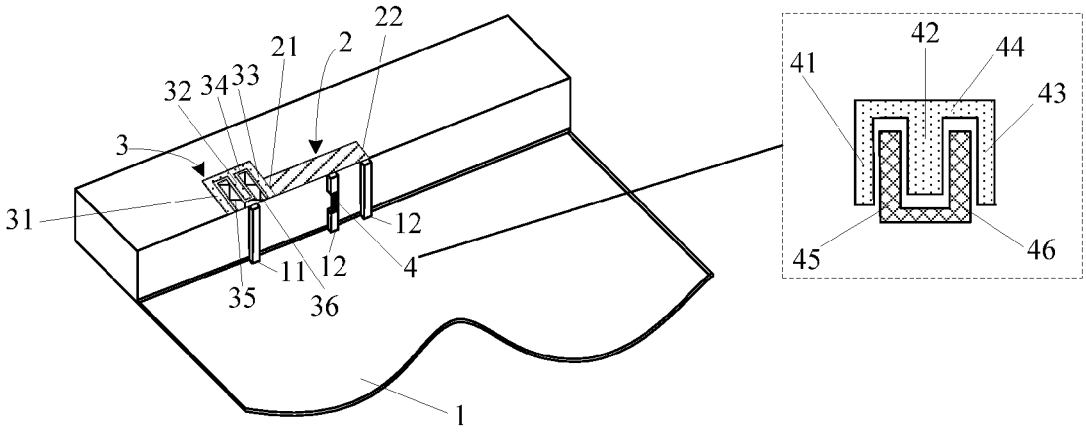
FIG. 10 is a sixth schematic diagram of an antenna according to an embodiment of the present invention.

As shown in FIG. 10, a portion indicated by oblique lines is the first radiator 2, both of the first capacitor structure 3 and the second capacitor structure 4 include the E-shape component and the U-shape component, where a portion indicated by dots is the E-shape component, and a portion indicated by double oblique lines is the U-shape component. The E-shape component includes a first branch 41, a second branch 42, a third branch 43, and a fourth branch 44, where the first branch 41 and the third branch 43 are connected to two ends of the fourth branch 44, the second branch 42 is located between the first branch 41 and the third branch 43, the second branch 42 is connected to the fourth branch 44, a gap is formed between the first branch 41 and the second branch 42, and a gap is formed between the second branch 42 and the third branch 43. The U-shape component includes two branches: a branch 45 and the other branch 46; the branch 45 of the U-shape component is located in the gap formed between the first branch 41 and the second branch 42 of the E-shape component, the other branch 46 of the U-shape component is located in the gap formed between the second branch 42 and the third branch 43 of the E-shape component, and the E-shape component and the U-shape component are not in contact with each other.

It should be noted that an "M"-shaped component also belongs to the E-shape component, that is, any structure including the first branch, second branch, third branch, and fourth branch, where the first branch and the third branch are connected to two ends of the fourth branch, the second branch is located between the first branch and the third branch, the second branch is connected to the fourth branch, a gap is formed between the first branch and the second branch, and a gap is formed between the second branch and the third branch, belongs to a scope claimed by this embodiment of the present invention; a "V"-shaped component also belongs to the U-shape component, that is, any component having two branches, where the two branches are separately located in the two gaps of the E-shape component, belongs to a scope claimed by this embodiment of the present invention, and the E-shape component and the U-shape component are not in contact with each other; for the convenience of drawing and description, in accompanying drawings of the first capacitor structure 3 and the second capacitor structure 4, only an "E" shape and a "U" shape are used for illustration.

Because the first capacitor structure 3 not only may be an ordinary capacitor build-up assembly, but also may include the E-shape component and the U-shape component, when the antenna further includes another radiator, different first capacitor structures lead to different connections of the another radiator.

Figure 11:
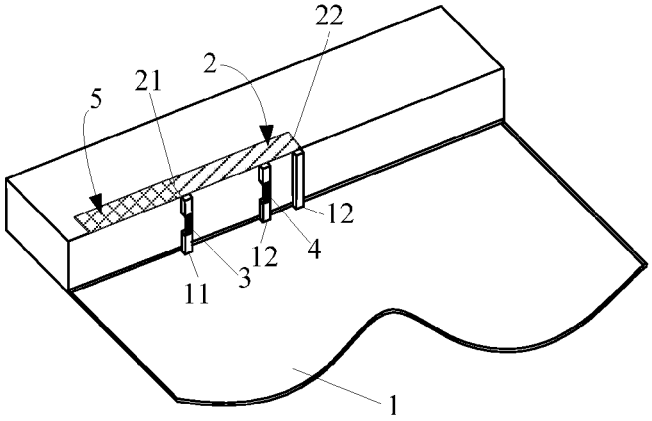
FIG. 11 is a seventh schematic diagram of an antenna according to an embodiment of the present invention.

When the first capacitor structure 3 is an ordinary capacitor build-up assembly, as shown in FIG. 11, the antenna further includes at least one second radiator 5, and one end of the second radiator 5 is electrically connected to the first end 21 of the first radiator 2.

Figure 12:
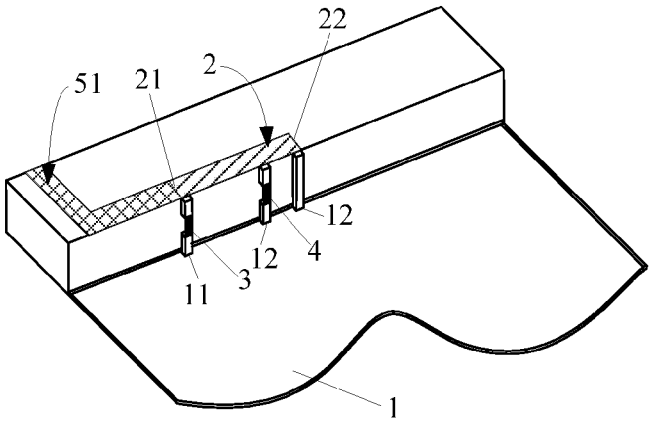
FIG. 12 is an eighth schematic diagram of an antenna according to an embodiment of the present invention.

Optionally, as shown in FIG. 12, the antenna further includes an L-shape second radiator 51, and one end of the L-shape second radiator 51 is electrically connected to the first end 21 of the first radiator 2. A portion indicated by left oblique lines is the first radiator 2, a portion indicated by double oblique lines is the second radiator 51, and portions indicated by the black color are the first capacitor structure 3 and the second capacitor structure 4. The L-shape second radiator 51 is configured to generate a third resonance frequency f3, where the third resonance frequency f3 covers LTE B7.

Figure 13:
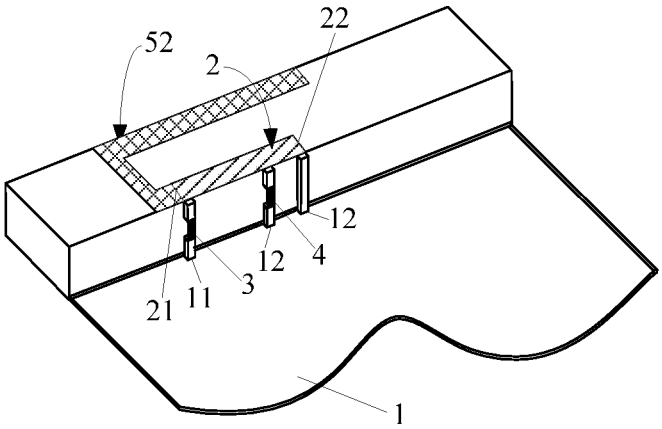
FIG. 13 is a ninth schematic diagram of an antenna according to an embodiment of the present invention.

Optionally, as shown in FIG. 13, the antenna may further include a [-shape second radiator 52, and one end of the [-shape second radiator 52 is electrically connected to the first end 21 of the first radiator 2. A portion indicated by left oblique lines is the first radiator 2, a portion indicated by double oblique lines is the second radiator 52, and portions indicated by the black color are the first capacitor structure 3 and the second capacitor structure 4. The [-shape second radiator 52 is configured to generate a fourth resonance frequency f4, where the fourth resonance frequency f4 covers WCDMA 2100.

Optionally, the antenna further includes two [-shape second radiators, and openings of the two [-shape second radiators are opposite to each other, where first ends of the second radiators are electrically connected to the first end of the first radiator, and second ends of the second radiators are opposite to each other and are not in contact with each other to form a coupling structure.

Figure 14:
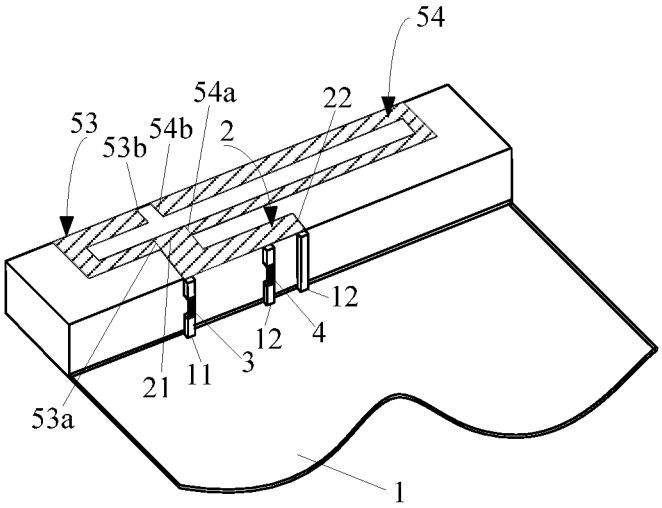
FIG. 14 is a tenth schematic diagram of an antenna according to an embodiment of the present invention.

As shown in FIG. 14, the two [-shape second radiators 5 are a second radiator 53 and a second radiator 54. A first end 53*a* of the second radiator 53 is electrically connected to the first end 21 of the first radiator 2, a first end 54*a* of the second radiator 54 is electrically connected to the first end 21 of the first radiator 2, and a second end 53*b* of the second radiator 53 and a second end 54*b* of the second radiator 54 are opposite to each other and are not in contact with each other to form a coupling structure. The second radiator 52 is configured to generate a fourth resonance frequency f4, where the fourth resonance frequency f4 covers WCDMA 2100; the second radiator 54 generates a fifth resonance frequency f5, where the fifth resonance frequency f5 covers GSM850 (824 MHz to 894 MHz) and GSM900 (880 MHz to 960 MHz); because a coupling structure is formed between the second radiator 52 and the second radiator 53, a sixth resonance frequency f6 may be generated, where the sixth resonance frequency f6 may cover LTE B3.

When the first capacitor structure 3 includes the E-shape component and the U-shape component, the antenna may include one or more of the following.

Optionally, the antenna further includes at least one second radiator 5, and one end of the second radiator 5 is electrically connected to either of the first branch 31 and the third branch 33.

Figure 15:
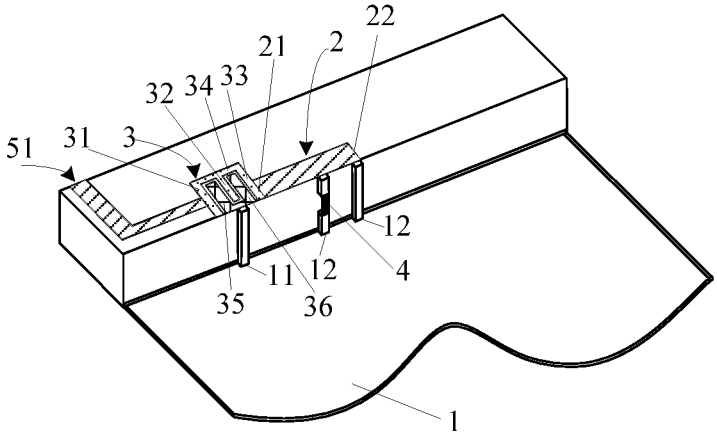
FIG. 15 is an eleventh schematic diagram of an antenna according to an embodiment of the present invention.

Optionally, as shown in FIG. 15, the antenna further includes an L-shape second radiator 51, and one end of the L-shape second radiator 51 is electrically connected to the first branch 31.

The L-shape second radiator 51 is configured to generate a third resonance frequency f3, where the third resonance frequency f3 covers LTE B7.

Figure 16:
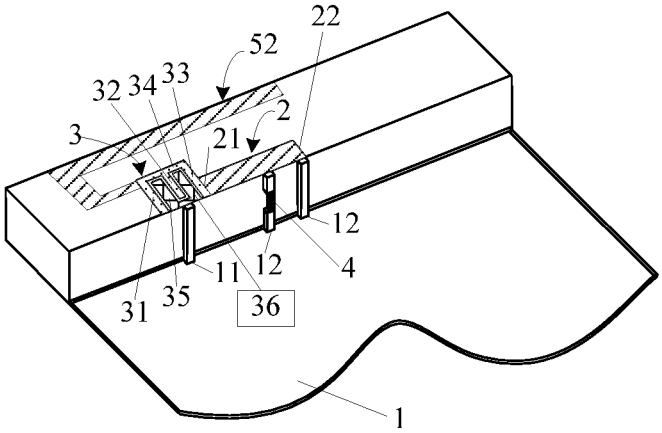
FIG. 16 is a twelfth schematic diagram of an antenna according to an embodiment of the present invention.

Optionally, the antenna further includes a [-shape second radiator 52, and one end of the [-shape second radiator 52 is electrically connected to either of the first branch 31 and the third branch 33. As shown in FIG. 16, one end of the [-shape second radiator 52 is electrically connected to the first branch 31.

When one end of the [-shape second radiator 52 is electrically connected to the first branch 31, the [-shape second radiator 52 is configured to generate a fourth resonance frequency f4, where the fourth resonance frequency f4 covers WCDMA 2100; when one end of the [-shape second radiator 52 is electrically connected to the first branch 31, the [-shape second radiator 52 is configured to generate a fifth resonance frequency f5, where the fifth resonance frequency f5 covers GSM850 (824 MHz to 894 MHz) and GSM900 (880 MHz to 960 MHz).

Optionally, the antenna further includes two [-shape second radiators, and openings of the two [-shape second radiators are opposite to each other, where one of the second radiators is electrically connected to the first branch, the other of the second radiators is electrically connected to the third branch, and second ends of the second radiators are opposite to each other and are not in contact with each other to form a coupling structure.

Figure 17:
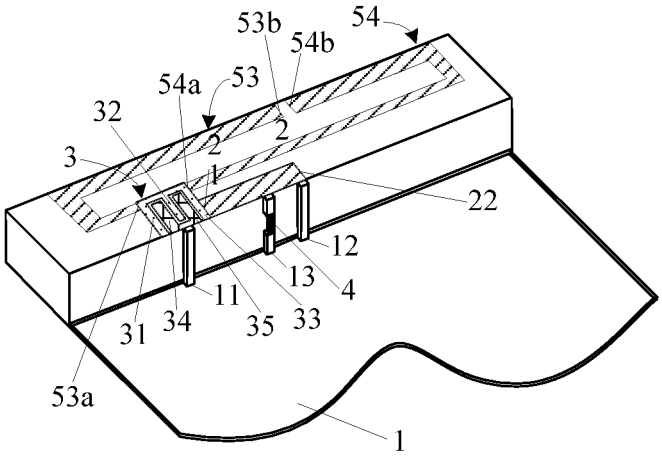
FIG. 17 is a thirteenth schematic diagram of an antenna according to an embodiment of the present invention.

As shown in FIG. 17, the two [-shape second radiators 5 respectively are the second radiator 53 and the second radiator 54, openings of the second radiator 53 and the second radiator 54 are opposite to each other, the first end 53*a* of the second radiator 53 is connected to the first branch 31 of the first capacitor structure 3, the first end 54*a* of the second radiator 54 is connected to the third branch 33 of the first capacitor structure 3, and the second end 53*b* of the second radiator 53 and the second end 54*b* of the second radiator 54 are opposite to each other and are not in contact with each other to form a coupling structure. The second radiator 53 is configured to generate a fourth resonance frequency f4, where the fourth resonance frequency f4 may cover WCDMA 2100; the second radiator 54 generates a fifth resonance frequency f5, where the fifth resonance frequency f5 may cover GSM850 (824 MHz to 894 MHz) and GSM900 (880 MHz to 960 MHz); because the second end 53*b* of the second radiator 53 and the second end 54*b* of the second radiator 54 are opposite to each other and are not in contact with each other to form a coupling structure, a sixth resonance frequency f6 is generated and may cover LTE B3.

In conclusion, the first resonance frequency f1 and the fifth resonance frequency f5 may cover low frequency bands of GSM/WCDMA/UMTS/LTE, the second resonance frequency f2 may cover LTE B21, and the third resonance frequency f3, the fourth resonance frequency f4, and the sixth resonance frequency f6 may cover high frequency bands of DCS/PCS/WCDMA/UMTS/LTE.

In the antenna provided by this embodiment, the first radiator 2 is located on an antenna support, and a distance between a plane on which the first radiator 2 is located and a plane on which the printed circuit board 1 is located is between 2 millimeters and 6 millimeters. In this way, a certain headroom area is reserved for designing the antenna, so as to improve performance of the antenna while implementing designing of a multi-resonance and bandwidth antenna in relatively small space.

Optionally, at least one second radiator 5 may also be located on the antenna support. The first capacitor structure 3 and/or the second capacitor structure 4 may also be located on the antenna support.

It should be noted that, when the antenna includes multiple radiators, different radiators in the antenna generate corresponding resonance frequencies, and generally, each radiator mainly transmits and receives the corresponding generated resonance frequency.

Embodiment 2

In this embodiment of the present invention, a simulation antenna model is established for the antenna in Embodiment 1 to perform simulation and practical testing.

Figure 18:
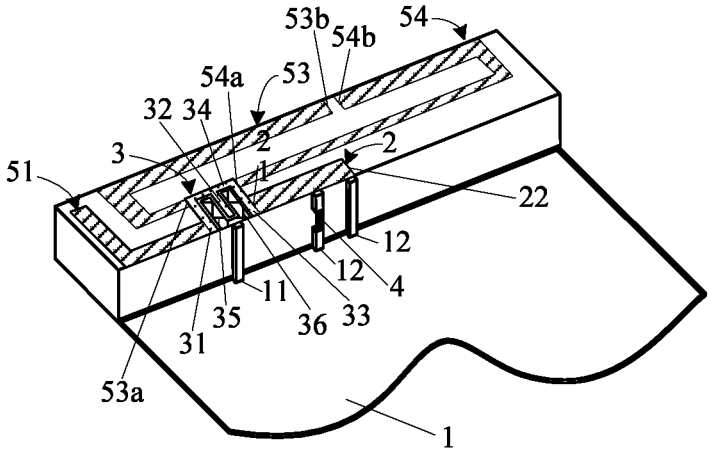
FIG. 18 is a fourteenth schematic diagram of an antenna according to an embodiment of the present invention.

As shown in FIG. 18, the antenna includes a first radiator 2, a first capacitor structure 3, a second capacitor structure 4, an L-shape second radiator 51, [-shape second radiator 53 and second radiator 54.

The first capacitor structure 3 includes an E-shape component and a U-shape component; the second capacitor structure 4 is an ordinary capacitor build-up assembly; a first end 21 of the first radiator 2 is connected to a third branch 33 of the first capacitor structure 3, one end of the second radiator 51 is connected to a first branch 31 of the first capacitor structure 3, a first end 53*a* of the second radiator 53 is connected to the first branch 31 of the first capacitor structure 3, a first end 54*a* of the second radiator 54 is connected to the third branch 33 of the first capacitor structure 3, and a second end 53*b* of the second radiator 53 and a second end 54*b* of the second radiator 54 are opposite to each other and are not in contact with each other to form a coupling structure.

Figure 19:
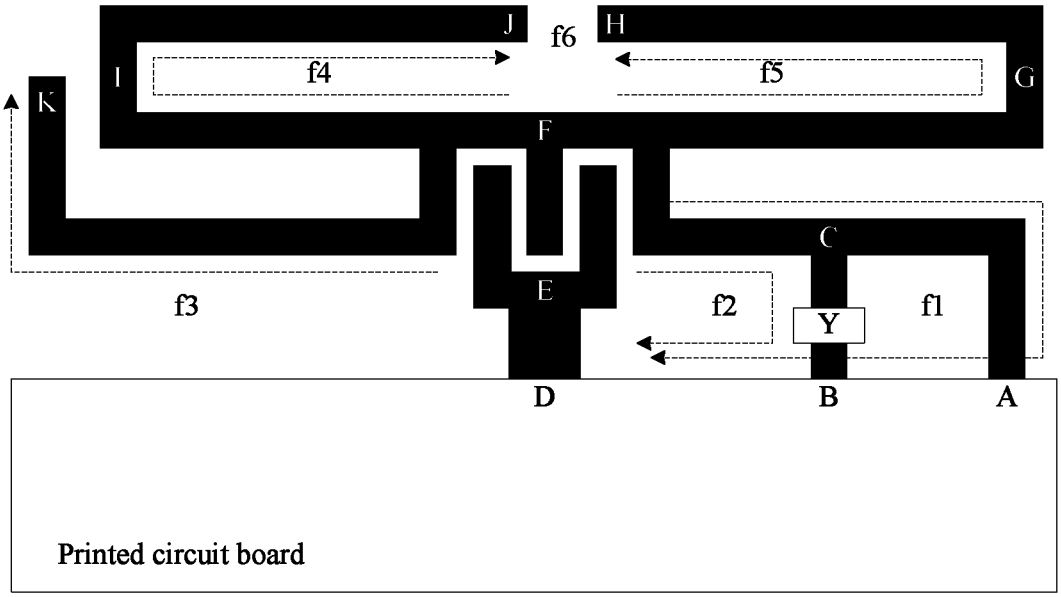
FIG. 19 is a schematic plane diagram of the antenna shown in the fourteenth schematic diagram according to an embodiment of the present invention.

To help understand the antenna, FIG. 19 is a schematic plane diagram of the antenna in FIG. 18. In FIGS. 19, D, E, F, C, and A are used to represent the first radiator 2, F and K are used to represent the second radiator 51, F, I, and J are used to represent the second radiator 53, and F, G, and H are used to represent the second radiator 54, the E-shape structure and U-shape structure represented by E and F are the first capacitor structure 3, Y is used to represent the second capacitor structure 4, A and B are a ground end of the printed circuit board, D is a signal feed end of the printed circuit board, and a white portion represents the printed circuit board 1.

Figure 20:
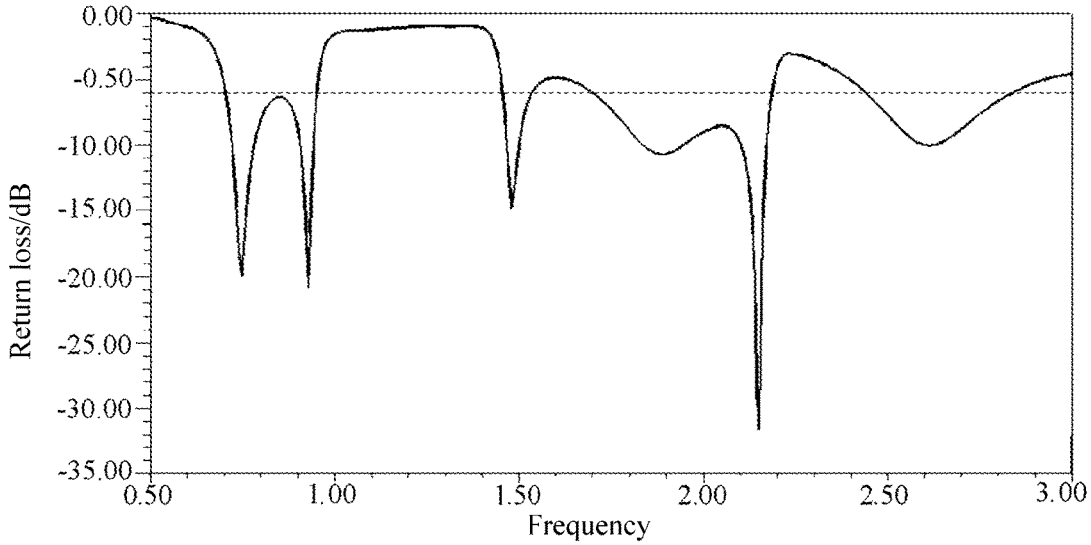
FIG. 20 is a loss diagram of return loss of the antenna shown in the fourteenth schematic diagram according to an embodiment of the present invention.

As shown in FIG. 20, which is a multi-frequency resonance return loss diagram of the antenna shown in FIG. 18, a horizontal coordinate represents a frequency (Frequency, Freq for short), a unit is gigahertz (GHz), a vertical coordinate represents a return loss, and a unit is decibel (dB). As can be seen from FIG. 20, a low operating frequency (the return loss is lower than −6 dB) can reach a minimum of about 680 MHz (megahertz), a low-frequency operating bandwidth ranges from 680 MHz to about 960 MHz, a high operating frequency of the antenna (the return loss is lower than −6 dB) can reach a maximum of over 2800 MHz, and a high-frequency operating bandwidth ranges from about 1440 MHz to over 2800 MHz. As can be seen from the foregoing, the antenna can cover low frequency bands of GSM/WCDMA/UMTS/LTE and high frequency bands of DCS/PCS/WCDMA/UMTS/LTE, and meanwhile, can also cover special frequency bands: LTE B7 (2500 MHz to 2690 MHz) and LTE B21 (1447.9 MHz to 1510.9 MHz), so as to satisfy requirements of most wireless terminal services on operating frequency bands.

Figure 21:
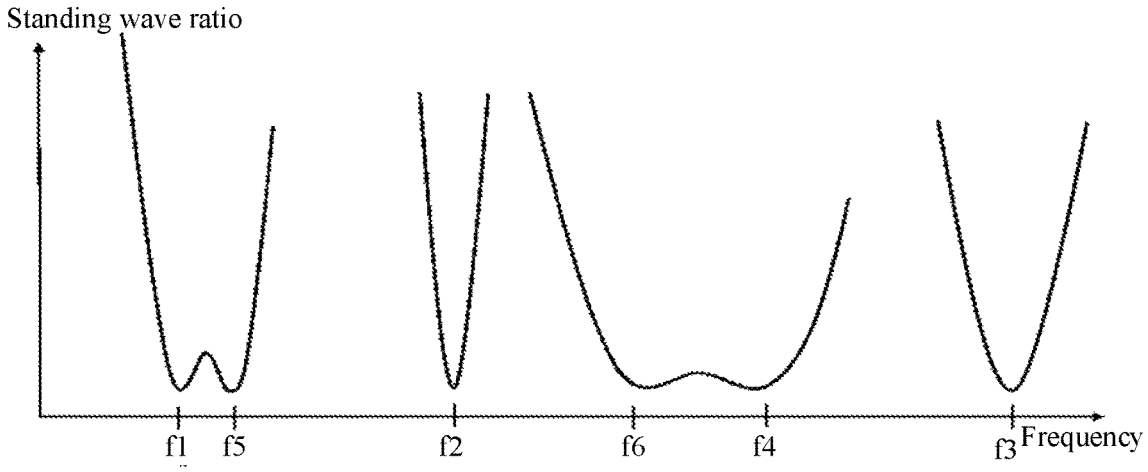
FIG. 21 is a frequency response diagram of the antenna shown in the fourteenth schematic diagram according to an embodiment of the present invention.

Because a return loss and a standing wave ratio can be converted into each other and represent a same meaning, FIG. 21 and FIG. 20 represent a same meaning, where FIG. 21 is a frequency-standing wave ratio diagram (a frequency response diagram) of the simulation antenna model, where a horizontal coordinate represents a frequency, and a vertical coordinate represents a standing wave ratio.

In conclusion, the antenna designed in this embodiment of the present invention can generate a low-frequency resonance and a high-frequency resonance, where a low frequency can cover 680 MHz to 960 MHz, and a high frequency can cover 1440 MHz to 2800 MHz; a resonance frequency may be controlled, by means of adjustment on a distributed inductor and a capacitor in series, to fall within special frequency bands: LTE B7 (2500 MHz to 2690 MHz) and LTE B21 (1447.9 MHz to 1510.9 MHz), so as to cover a frequency band required by a current 2G/3G/4G communication system.

In addition, because between the first end 21 and second end 22 of the first radiator 2, the ground end 12 of the printed circuit board 1 is electrically connected by means of the second capacitor structure 4, a position, between the first end 21 and second end 22 of the first radiator 2, of the second capacitor structure 4 may be adjusted, so that the antenna generates different resonance frequencies.

Figure 22:
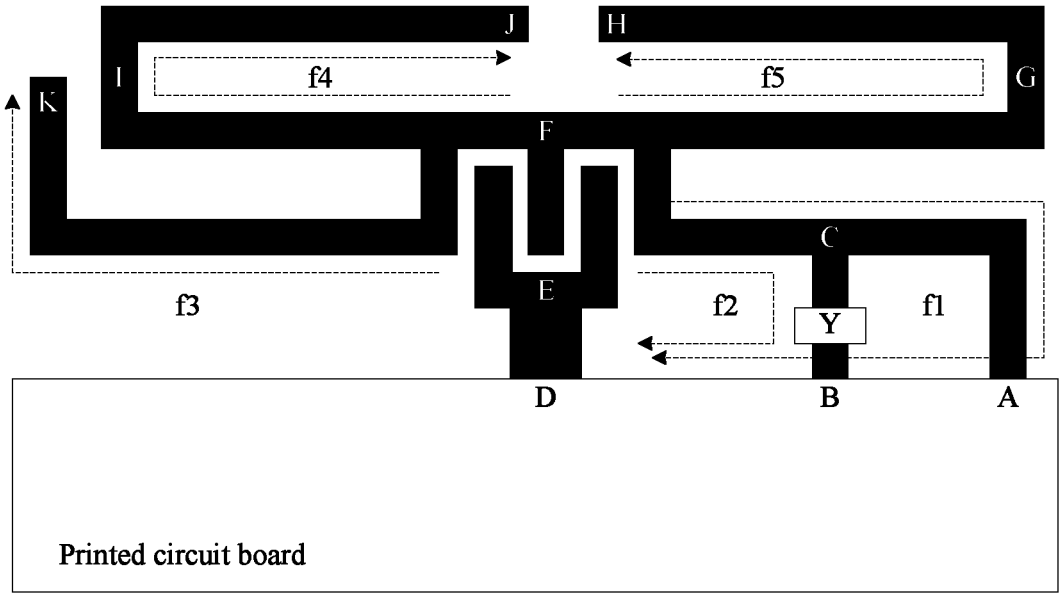
FIG. 22 is a schematic diagram of a resonance frequency that is generated after adjustment is performed on the antenna shown in the fourteenth schematic diagram according to an embodiment of the present invention.
Figure 23:
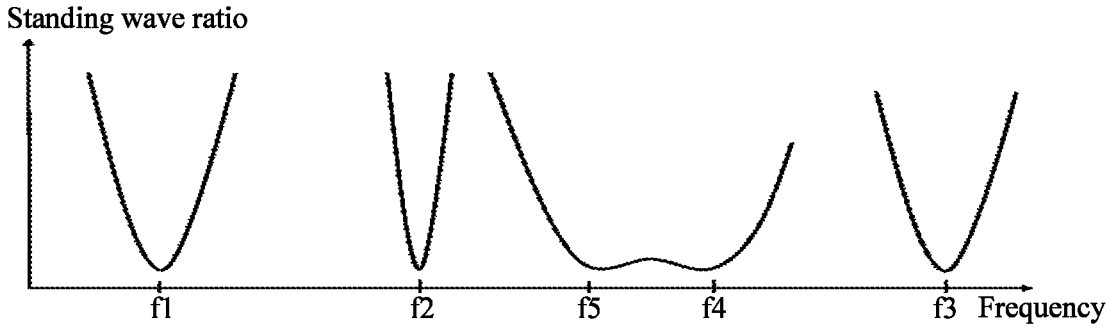
FIG. 23 is a diagram of a frequency response that is generated after adjustment is performed on the antenna shown in the fourteenth schematic diagram according to an embodiment of the present invention.

FIG. 18 shows a schematic diagram of multiple resonance frequencies (in FIG. 22, f1 to f5 are used as an example for description) that can be generated by the antenna by means of adjustment on electrical lengths of the first radiator 2, the second radiator 51, the second radiator 53, the second radiator 54, and a position, between the first end 21 and second end 22 of the first radiator 2, of the second capacitor structure 4. FIG. 23 is a frequency-standing wave ratio diagram of the antenna shown in FIG. 22, where a horizontal coordinate represents a frequency, a unit is megahertz (MHz), and a vertical coordinate represents a standing wave ratio; a first resonance frequency f1 generated by the first radiator 2 is used to cover low frequency bands such as LTE B13, LTE B17, LTE B20, GSM850 (824 MHz to 894 MHz), and GSM900 (880 MHz to 960 MHz), a second resonance frequency f2 generated by an F-C-B section of the first radiator 2 may cover LTE B21, a third resonance frequency f3 generated by the second radiator 51 may cover LTE B7, a fourth resonance frequency f4 generated by the second radiator 53 may cover WCDMA 2100, and a fifth resonance frequency f5 generated by the second radiator 54 may cover LTE B3. In conclusion, the first resonance frequency f1 may cover low frequency bands of GSM/WCDMA/UMTS/LTE, the second resonance frequency f2 may cover a special frequency band LTE B21, and the third resonance frequency f3, the fourth resonance frequency f4, and the fifth resonance frequency f5 may cover high frequency bands of DCS/PCS/WCDMA/UMTS/LTE.

The antenna provided in this embodiment of the present invention includes a first radiator, a first capacitor structure, a second capacitor structure, and three second radiators; a first end of the first radiator is electrically connected to a signal feed end of a printed circuit board by means of the first capacitor structure, a second end of the first radiator is electrically connected to a ground end of the printed circuit board, the first radiator, the first capacitor structure, the signal feed end, and the ground end form a first antenna, configured to generate a first resonance frequency, and an electrical length of the first radiator is less than or equal to one eighth of a wavelength corresponding to the first resonance frequency, so that the volume of the antenna can be reduced. In addition, other resonance frequencies are generated by using the second radiator and the second capacitor structure, so that the antenna not only has multiple resonance bandwidth but also has a relatively small size, and a multi-resonance wideband antenna can be designed in relatively small space.

Embodiment 3

Figure 24:
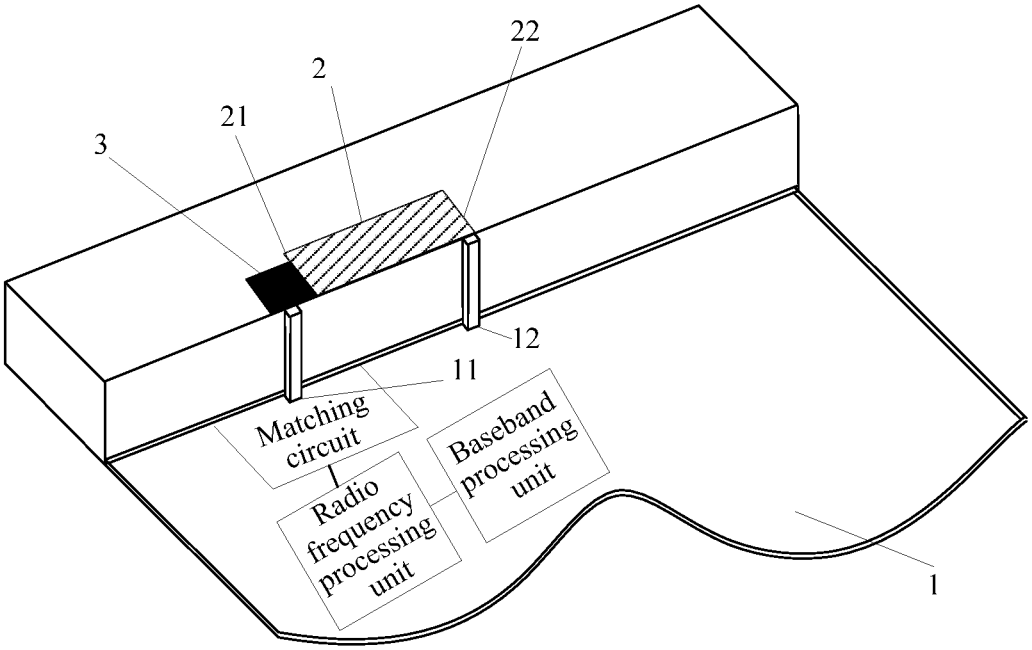
FIG. 24 shows a mobile terminal according to an embodiment of the present invention.

This embodiment of the present invention provides a mobile terminal. As shown in FIG. 24, the mobile terminal includes a radio frequency processing unit, a baseband processing unit, and an antenna, where the antenna includes a first radiator 2 and a first capacitor structure 3, where a first end 21 of the first radiator 2 is electrically connected to a signal feed end 11 of a printed circuit board 1 by means of the first capacitor structure 3, a second end 22 of the first radiator 2 is electrically connected to a ground end 12 of the printed circuit board 1, the first radiator 2, the first capacitor structure 3 the signal feed end 11, and the ground end 12 form a first antenna, configured to generate a first resonance frequency f1, and an electrical length of the first radiator 2 is less than or equal to one eighth of a wavelength corresponding to the first resonance frequency f1. The radio frequency processing unit is electrically connected to the signal feed end 11 of the printed circuit board 1 by means of a matching circuit. The antenna is configured to transmit a received radio signal to the radio frequency processing unit or convert a transmitted signal of the radio frequency processing unit into an electromagnetic wave and send the electromagnetic wave; the radio frequency processing unit is configured to perform frequency selection, amplification, and down-conversion on the radio signal received by the antenna, convert the radio signal to an intermediate frequency signal or a baseband signal, and send the intermediate frequency signal or baseband signal to the baseband processing unit, or configured to perform up-conversion and amplification on a baseband signal or an intermediate frequency signal sent by the baseband processing unit and send the baseband signal or intermediate frequency by using the antenna; and the baseband processing unit performs processing on the received intermediate frequency or baseband signal.

The matching circuit is configured to adjust impedance of the antenna to match the impedance of the antenna with impedance of the radio frequency processing unit, so as to generate a resonance frequency satisfying a requirement. The first resonance frequency f1 may cover low frequency bands such as LTE B13, LTE B17, and LTE B20.

It should be noted that the first radiator 2 is located on an antenna support, and a distance between a plane on which the first radiator 2 is located and a plane on which the printed circuit board 1 is located is between 2 millimeters and 6 millimeters. In this way, a certain headroom area is designed for the antenna, so as to improve performance of the antenna while implementing designing of the antenna in relatively small space.

Figure 25:
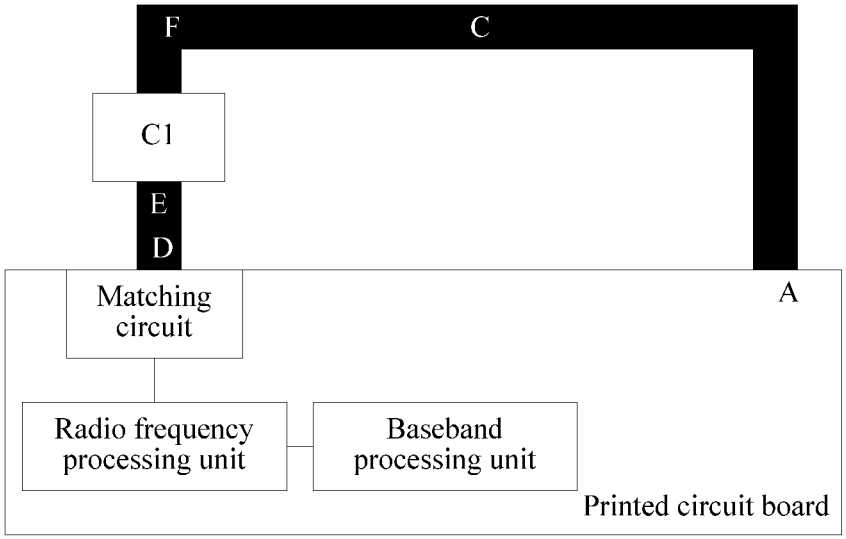
FIG. 25 is a schematic plane diagram of a mobile terminal according to an embodiment of the present invention.

FIG. 25 is a schematic plane diagram of the mobile terminal shown in FIGS. 24, where D, E, F, C, and A are used to represent the first radiator 2, C1 is used to represent the first capacitor structure 3, A represents the ground end 12 of the printed circuit board 1, D presents the signal feed end 11 of the printed circuit board 1, and the matching circuit is electrically connected to the signal feed end 11 of the printed circuit board 1.

Certainly, the antenna in this embodiment may also include either antenna structure described in Embodiment 1 and Embodiment 2. For details, reference may be made to the antennas described in Embodiment 1 and Embodiment 2, and no further details are described herein again. The mobile terminal may be a communication device that is used during movement, may be a mobile phone, or may also be a tablet computer, a data card, or the like, and certainly, is not limited thereto.

Finally, it should be noted that the foregoing embodiments are merely provided for describing the technical solutions of the present invention, but not intended to limit the present invention. It should be understood by persons of ordinary skill in the art that although the present invention has been described in detail with reference to the foregoing embodiments, modifications can be made to the technical solutions described in the foregoing embodiments, or equivalent replacements can be made to some technical features in the technical solutions, as long as such modifications or replacements do not cause the essence of corresponding technical solutions to depart from the spirit and scope of the technical solutions according to the embodiments the present invention.

What is claimed is:

1. An antenna, comprising:

a first radiator;

a first capacitor structure; and a second capacitor structure;

wherein a first end of the first radiator is electrically connected to a signal feed end of a printed circuit board by the first capacitor structure, wherein a second end of the first radiator is electrically connected to a ground end of the printed circuit board, wherein the first radiator, the first capacitor structure, the signal feed end, and the ground end form a first antenna, configured to generate a first resonance frequency, and wherein an electrical length of the first radiator is less than or equal to one eighth of a wavelength corresponding to the first resonance frequency;

wherein the antenna further comprises at least one second radiator, and one end of the second radiator is electrically connected to the first end of the first radiator;

wherein a first end of the second capacitor structure is electrically connected to the first radiator between the first end and the second end of the first radiator, and a second end of the second capacitor structure is electrically connected to the ground end of the printed circuit board; and wherein the second capacitor structure comprises an E-shape component and a U-shape component.

2. The antenna according to claim 1, wherein the E-shape component comprises a first branch, a second branch, a third branch, and a fourth branch, wherein the first branch and the third branch are connected to two ends of the fourth branch, the second branch is located between the first branch and the third branch, the second branch is connected to the fourth branch, a first gap is disposed between the first branch and the second branch, and a second gap is disposed between the second branch and the third branch; and wherein the U-shape component comprises two branches, the two branches of the U-shape component are separately located in the first and second gaps of the E-shape component, and the E-shape component and the U-shape component are not in contact with each other.

3. The antenna according to claim 1, wherein the first capacitor structure comprises an E-shape component and a U-shape component, wherein the E-shape component comprises a first branch, a second branch, a third branch, and a fourth branch, wherein the first branch and the third branch are connected to two ends of the fourth branch, the second branch is located between the first branch and the third branch, the second branch is connected to the fourth branch, a first gap is disposed between the first branch and the second branch, and a second gap is disposed between the second branch and the third branch; and wherein the U-shape component comprises two branches, the two branches of the U-shape component are separately located in the first and second gaps of the E-shape component, and the E-shape component and the U-shape component are not in contact with each other.

4. The antenna according to claim 3, wherein the first end of the first radiator is electrically connected to the first branch or the third branch of the first capacitor structure.

5. The antenna according to claim 3, wherein the antenna further comprises at least one second radiator, and one end of the second radiator is electrically connected to either of the first branch and the third branch.

6. The antenna according to claim 5, wherein the antenna comprises an L-shape second radiator, and one end of the L-shape second radiator is electrically connected to the first branch.

7. The antenna according to claim 5, wherein the antenna comprises a [-shape second radiator, and a first end of the [-shape second radiator is electrically connected to either of the first branch and the third branch.

8. The antenna according to claim 1, wherein the antenna further comprises an L-shape second radiator, and one end of the L-shape second radiator is electrically connected to the first end of the first radiator.

9. The antenna according to claim 1, wherein the antenna further comprises a [-shape second radiator, and one end of the [-shape second radiator is electrically connected to the first end of the first radiator.

10. The antenna according to claim 1, wherein the antenna further comprises two [-shape second radiators, and openings of the two [-shape second radiators are opposite to each other, wherein first ends of the second radiators are electrically connected to the first end of the first radiator, and second ends of the second radiators are opposite to each other and are not in contact with each other to form a coupling structure.

11. The antenna according to claim 1, wherein the first radiator is located on an antenna support, and wherein a distance between a plane on which the first radiator is located and a plane on which the printed circuit board is located is between 2 millimeters and 30 millimeters.

12. A mobile terminal, comprising:

a radio frequency processing unit;

a baseband processing unit; and an antenna, wherein the antenna comprises a first radiator and a first capacitor structure, wherein a first end of the first radiator is electrically connected to a signal feed end of a printed circuit board by the first capacitor structure, wherein a second end of the first radiator is electrically connected to a ground end of the printed circuit board, wherein the first radiator, the first capacitor structure, the signal feed end, and the ground end form a first antenna, configured to generate a first resonance frequency, and wherein an electrical length of the first radiator is less than or equal to one eighth of a wavelength corresponding to the first resonance frequency;

wherein the radio frequency processing unit is electrically connected to the signal feed end of the printed circuit board by a matching circuit; and wherein the antenna is configured to transmit a received radio signal to the radio frequency processing unit or convert a transmitted signal of the radio frequency processing unit into an electromagnetic wave and send the electromagnetic wave; the radio frequency processing unit is configured to perform frequency selection, amplification, and down-conversion on the radio signal received by the antenna, convert the radio signal to an intermediate frequency signal or a baseband signal, and send the intermediate frequency signal or baseband signal to the baseband processing unit, or configured to perform up-conversion and amplification on a baseband signal or an intermediate frequency signal sent by the baseband processing unit and send the baseband signal or intermediate frequency by using the antenna; and the baseband processing unit performs processing on the received intermediate frequency or baseband signal.

13. The mobile terminal according to claim 12, wherein the antenna further comprises a second capacitor structure, a first end of the second capacitor structure is electrically connected to the first radiator between the first end and the second end, and a second end of the second capacitor structure is electrically connected to the ground end of the printed circuit board.

14. The mobile terminal according to claim 12, wherein the first capacitor structure comprises an E-shape component and a U-shape component;

wherein the E-shape component comprises a first branch, a second branch, a third branch, and a fourth branch, wherein the first branch and the third branch are connected to two ends of the fourth branch, the second branch is located between the first branch and the third branch, the second branch is connected to the fourth branch, a first gap is disposed between the first branch and the second branch, and a second gap is disposed between the second branch and the third branch; and wherein the U-shape component comprises two branches, the two branches of the U-shape component are separately located in the first and second gaps of the E-shape component, and the E-shape component and the U-shape component are not in contact with each other.

15. The mobile terminal according to claim 14, wherein the first end of the first radiator is electrically connected to the first branch or the third branch of the first capacitor structure.

16. The mobile terminal according to claim 14, wherein the antenna further comprises at least one second radiator, and one end of the second radiator is electrically connected to either of the first branch and the third branch.

17. The mobile terminal according to claim 12, wherein the antenna further comprises at least one second radiator, and one end of the second radiator is electrically connected to the first end of the first radiator.

18. The mobile terminal according to claim 12, wherein the first radiator is located on an antenna support, and a distance between a plane on which the first radiator is located and a plane on which the printed circuit board is located is between 2 millimeters and 30 millimeters.

* * * * *